United States Patent [19]

Naab

[11] Patent Number: 4,722,656

[45] Date of Patent: Feb. 2, 1988

[54] DEVICE FOR EMPTYING CONTAINERS, ESPECIALLY REFUSE BINS

[75] Inventor: Jakob Naab, Mainz, Fed. Rep. of Germany

[73] Assignee: Zoller-Kipper GmbH, Mainz-Laubenheim, Fed. Rep. of Germany

[21] Appl. No.: 788,939

[22] PCT Filed: Feb. 15, 1985

[86] PCT No.: PCT/EP85/00052

§ 371 Date: Oct. 18, 1985

§ 102(e) Date: Oct. 18, 1985

[87] PCT Pub. No.: WO85/03689

PCT Pub. Date: Aug. 29, 1985

[51] Int. Cl.[4] ..... B65F 3/04

[52] U.S. Cl. ..... 414/303; 91/35; 91/36; 364/478; 414/21; 414/408; 414/421

[58] Field of Search ..... 414/421, 422, 419, 420, 414/403, 404, 408, 303, 21, 44, 111, 551, 555, 552; 235/375; 364/466, 478, 567; 91/35, 36

[56] References Cited

U.S. PATENT DOCUMENTS

| | | | |
|---|---|---|---|
| 3,263,842 | 8/1966 | Holstein | 414/422 X |
| 3,332,560 | 7/1967 | Niepmann | 414/421 X |
| 3,599,806 | 8/1971 | Fishcher | 414/44 X |
| 3,738,516 | 6/1973 | Wells | 414/345 X |
| 4,259,035 | 3/1981 | DeCoene et al. | 414/44 X |
| 4,544,280 | 10/1985 | Mitsukawa | 364/567 X |

FOREIGN PATENT DOCUMENTS

| | | | |
|---|---|---|---|
| 1399454 | 7/1975 | United Kingdom | 414/404 |

*Primary Examiner*—Robert J. Spar
*Assistant Examiner*—Stuart J. Millman
*Attorney, Agent, or Firm*—H. Gibner Lehmann; K. Gibner Lehmann

[57] ABSTRACT

A device for emptying refuse bins, having a tipping frame to engage the bin, a fluid-actuated motor connected to the tipping frame for moving it between a first position wherein it is capable of initial engagement with and holding of the bin, and a second, tilted position, wherein the bin is partially inverted, so as to empty the contents thereof into a larger, collecting container. A switch is provided, responsive to placement of the bin in position on the frame. The device further includes a control circuit having a timing device operated by the switch. The switch initiates operation of the timing device to direct the functioning of the fluid-actuated motor. In a preferred embodiment, the switch is mechanical and is adapted to be engaged by the walls of the refuse bin. Upon the expiration of a predetermined interval established by the timing device, power to the fluid-actuated motor is removed, and the tipping frame carrying the emptied bin is returned to its initial position.

14 Claims, 6 Drawing Figures

DEVICE FOR EMPTYING CONTAINERS, ESPECIALLY REFUSE BINS

Applicant hereby claims priority under 35 USC 120 and 365(c), of PCT Application No. PCT/EP 85/00052, filed Feb. 15, 1985.

The invention relates to a device for emptying containers, especially for emptying refuse bins into collecting containers, in which a lifting and tipping device, or a tipping device, driven by at least one pressure medium motor is provided with a lifting and tipping frame, or with a tipping frame, that holds the container to be emptied, wherein the pressure medium motor or motors is/are controlled by means of a pressure medium valve inserted in the pressure medium-power circuit, which pressure medium valve is connected directly or indirectly with its actuating mechanism to a control circuit that contains a time switch determining the timed valve control of the valve for the sequence of movement.

A device of this kind is known from DE-A No. 27 21 059, in which a pressure switch disposed laterally with respect to the tipper and intended for hand-actuation is provided as the element starting up the emptying process. It is necessary first of all to position the container to be emptied on the tipping frame, or lifting and tipping frame, or at least approximately to bring the container into a suitable position, and then to actuate the hand switch starting up the automatic sequence of the emptying process. In practice it is inevitable that the containers brought towards or placed on the lifting and tipping frame, or the tipping frame, will sometimes not be gripped correctly by this. The device known from DE-A No. 27 21 059 therefore carries an increased risk of accidents.

Furthermore, DE-PS No. 1,028,935 discloses a dustbin tipper in which the control valve for the pressure medium motor is provided with a hand-actuating element which, when the valve has been brought into the actuating position for the pressure medium motor, may be inserted behind a retaining bolt. A disconnecting lever, likewise arranged in the pressure medium-power circuit, is allocated to this retaining bolt in such a manner that it pushes the hand-actuating element of the control valve behind the retaining bolt forward and, to return the control valve to its initial position, releases it as soon as the load of compressed air on the disconnecting lever has reached a corresponding level. The disconnecting lever itself is controlled from an overflow valve which is actuated by the pivot axle of the tipping device, or lifting and tipping device. If it is desirable to provide for the container to be emptied to be vibrated when it is in its tipping-in position, then a suitable actuating cam could be provided on the pivot axle of the tipping device, or lifting and tipping device, for the overflow valve, and a flow throttle could be provided in the feed line to the disconnecting lever. By this means, a repeated tipping in and tilting back movement is caused when the tipping device, or lifting and tipping device, is towards the end of its tipping range, until the disconnecting lever is loaded sufficiently by pressure medium to release the hand-actuating element from the retaining bolt, so that the control valve is able to return to its initial position. This known device requires, firstly, pneumatic pressure medium-power circuits, and above all requires the emptying process to be initiated by hand actuation of the control valve, and the hand-actuated element of the control valve to be locked.

These two known devices also make it essential, when operation is carried out by a single individual, that either the container to be emptied is hooked onto appropriate devices of the lifting and tipping frame, or tipping frame, or that the operator simultaneously keeps hold of the container to be emptied and operates the control valve, which frequently results in the container being incorrectly held on the lifting and tipping frame, or tipping frame, and/or in incorrect operation of the control valve. To ensure that the container to be emptied is safely held on the lifting and tipping frame, or tipping frame, and to ensure reliable operation of the actuating valve, two persons would normally be required for operation of the known devices described above.

Compared with this, the invention is based on the problem of appreciably improving a device of the kind decribed in the introduction, such that it is possible to control the emptying process substantially automatically, which allows the container to be emptied merely to be brought by a single operator to the lifting and tipping frame, or tipping frame, and allows the operator to leave the device during the tipping process, for example to take away an empty container and fetch another container to be emptied. It is intended that the improved device shall be operable using pressure medium systems of any kind, whether using hydraulic or pneumatic pressure media, and shall have a simple construction, a simple method of operation, a high degree of operational reliability and an especially economic principle of operation. Furthermore, the invention shall ensure that during the automatic emptying process there shall be no danger from this device to the operating crew of persons unconnected with operation.

To solve this problem, according to the invention provision is made for the control circuit of the pressure medium valve to contain a circuit element for initiating the control sequence, the element being actuated by the container itself placed on the lifting and tipping frame, or tipping frame, of the emptying device.

As a result of the circuit element for initiating the control sequence being arranged according to the invention for direct actuation by the container to be emptied, the function of the operator is merely to ensure that the container is safely and correctly brought up to and placed on the emptying device, in order thereby simultaneously to ensure the correct positioning of the container on the emptying device and to start off the control sequence for the emptying process. Even in the case of one-man operation, it is possible by this means to achieve a substantially improved degree of safety when the emptying process progresses automatically.

The circuit element actuated by the container may be a contact switch cooperating with parts on the container. Such contact switches after the advantage that they are mechanically operated only when the container has been placed in the correct position.

The circuit element actuated by the container may also be formed by one or more non-contact sensors cooperating with parts on the container. Sensors of various kinds may be considered for this purpose, for example ultrasonic sensors, which respond to reflection of ultrasonic waves striking the container wall. Magnetic switches which respond to the approach of magnetic parts affixed to the container wall may also be considered. Moreover, optically or electrically operating sensors of any kind may be considered.

A further possibility according to the invention consists in the circuit element actuated by the container being formed by one or more photoelectric barriers cooperating with the container. Preferably, for safety reasons, several photoelectric barriers arranged at different points close to the lifting and tipping frame, or tipping frame, will be provided, all of which are to be masked by the container wall in order to initiate the switching process, so that a switching process cannot be caused by any objects accidentally coming into the range of a photoelectric barrier.

Normally, the signal generated by the circuit element actuated by the container will be transmitted by way of cable connections to the corresponding parts of the control circuit. It is also possible, however, to transmit wireless signals from the circuit element actuated by the container by means of a small transmitter and small receiver, for example by means of ultrasound or electromagnetic waves, to a receiver which is inserted in the control circuit of the pressure medium valve.

As the circuit element actuated by the container to be emptied is generally permanently installed and in many cases is arranged on the tipping frame, or lifting and tipping frame, and as, on the other hand, in many cases containers of quite different designs with considerable differences in the construction of their lateral limiting walls are still simultaneously in current use, it is advisable within the scope of the invention to provide a hand-actuated switch in parallel with the circuit element actuated by the container to be emptied or in parallel with the receiver inserted in the control circuit. The point of this additional hand switch is that the operator can initiate the emptying process by means of the hand-actuated switch should a container that is not suitable for the automatic actuation of the circuit element have been brought onto the emptying device. The hand-actuated switch for switching on the control sequence may be disposed on the actuating mechanism of the control valve, and a common hand-operated element may be provided for the hand-actuated switch and the control valve.

In a preferred embodiment of the invention, the electrical control circuit provided for the timed control of the valve is designed such that, on release of the switch actuated by the attached container, it constrains the tipping device, or lifting and tipping device, to return to its initial position, preferably immediately on release of this switch or an interruption of the power circuit completed with the switch. By this means, when the container to be emptied has been incorrectly or unsafely gripped by the tipping, or lifting and tipping, device, the emptying process that has commenced is immediately discontinued and reset, in order that the container to be emptied can be repositioned. It is especially advantageous herein to design the switch actuated by the attached container to be held in its closed state by the container, and to design the time switch such that, when the electrical current conducted via the switch actuated by the container ceases, the time switch immediately reverts to its control position for returning the tipping device, or lifting and tipping device, to its initial position.

In a further embodiment of the invention, provision is made for the electrical control circuit to trigger a secondary control circuit operated by means of a pressure medium; this is performed such that a reversing valve set up for electrical operation, and optionally also for manual operation, and connected to a source of pressure medium is switched by way of the time switch of the control circuit, the time switch being constructed as a time relay. In this case, the pressure medium valve provided for the control of the pressure medium motor or pressure medium motors is set up for operation by pressure media. The arrangement of an additional pressure medium control circuit may, under some circumstances, be an advantage when the one for an electrical actuating mechanism of the control valve in the power-pressure medium circuit is inadequate, or when there is no sufficiently reliable source of electricity available. Another advantage is produced from the fact that by the use of, for example, a pneumatic secondary control pressure medium circuit, a buffer is arranged between the electrical circuit elements and the pressure medium-power circuit or the valves located in the pressure medium-power circuit. The force required for actuating the valve arranged in the power-pressure medium circuit can be reinforced by such a buffer and the control energy may be increased. The control valve lying in the pressure medium-power circuit may be a two-position valve having a neutral and a working position. This is especially favourable in view of the fact that the actuating mechanism of such a two-position valve can be of especially simple construction. In an hydraulic pressure medium-power circuit it is advisable to connect such a two-position valve in the neutral position on a bypass line connected to the return line of the pressure medium-power circuit.

For the gentle vibration of the containers to be emptied, when the tipping device has an hydraulic drive a valve that rhythmically interrupts or constricts the pressure medium flow and is actuated by the control circuit can be inserted in the feed of the pressure medium-power circuit to the drive element for the tipping device.

The invention may be used both for single tippers and for multiple tippers, for example double or twin tippers, triple tippers etc., that is to say, for tippers in which two or more separately operable individual lifting and tipping devices, or individual tipping devices, are arranged next to one another. Equally, the invention may be applied in the case of so-called combination tippers, namely, those tippers in which two or more individual lifting and tipping devices, or individual tipping devices, are arranged next to one another and can be actuated separately or together, according to choice, so that the individual lifting and tipping devices or individual lifting devices can be used separately from and independently of one another for emptying relatively small containers and all the lifting and tipping devices or tipping devices can be used jointly for emptying relatively large containers.

For use with combination tippers, provision may be made within the scope of the invention for the automatic sequence of the emptying process to be effected both in the case of separate operation on all lifting and tipping devices or individual tipping devices and for a modified automatic sequence of the emptying process to be carried out in the case of combined operation of all the lifting and tipping, or tipping, devices. For more simple instances of application, the invention offers the opportunity, however, for the automatic sequence of the emptying process to be provided only for the operation as individual lifting and tipping devices or individual tipping devices, and for an improved manual control operation to be provided for the operation as a combination tipper. This gives the advantage that the operator himself substantially controls the emptying process where a combination tipper is involved and is able to adapt it to the factors of the individual case which are essentially more apparent with larger containers. Within the scope of the invention an embodiment is therefore proposed in which for the pressure medium motors of each lifting and tipping, or tipping, device there are provided two identical pressure medium-power circuits that may be made parallel and may be separated from one another by means of a reversing valve designed as a shut-off and on-off valve and set up for electrical, and optionally manual, operation. Together with the electrical control circuits provided for each individual lifting and tipping device, or each individual tipping device, this reversing valve is connected by way of a common switch to a source of electricity and is in the shut-off position when the switch is closed. By the feature provided in this embodiment of two separate electrical control circuits for the two lifting and tipping devices, or tipping devices, when the source of electricity is switched on then automatic emptying processes can be undertaken with both lifting and tipping devices, or tipping devices, independently of one another. On the other hand, should the two individual lifting and tipping devices or individual tipping devices be operated jointly and synchronously in order to empty large containers, then the automatic control system is switched off. In this case, the reversing switch arranged between the two pressure medium-power circuits is in such a switch position that the pressure medium motors of the two lifting and tipping devices or tipping devices are fed from a common source of pressure medium. Switching off the automatic control system in the case of joint operation of the two lifting and tipping devices or tipping devices takes account of the fact that, with larger containers, the duration for the emptying process can be very varied. With a fixed time constant of the time switch determining the timed valve control for the sequence of movement, the simple embodiment of the invention would not therefore always be economic. Other conditions obtain, as explained further below, if the weight when full of the container prior to emptying is determined by additional facilities and this additional information is taken into account in the automatic control of the emptying process.

With joint operation of the two individual lifting and tipping devices or individual tipping devices, and when the control valves for the pressure medium motors are designed as two-position valves, within the scope of the invention provision may be made for a second reversing valve to be provided in addition to the reversing valve arranged between the two pressure medium-power circuits. This second reversing valve is controlled inversely to the first reversing valve and is inserted in a power circuit upstream of the junction of the pressure medium connecting line with the pressure medium supply line to the pressure medium motors. By this means, merely by disconnecting the source of electricity from the two electrical control circuits and the electrically operated control valves, for example by means of a main switch, the device for the joint actuation of the two lifting and tipping devices, or tipping devices, is advantageously made ready for emptying large containers.

Since the operator is occupied during the automatic emptying process with the business of fetching the next container to be emptied, and the emptying process thus proceeds without supervision, safety measures to protect persons not involved in the operation, for example, passers-by, are advisable. To this end, within the scope of the invention, on the lateral walls of the collecting container are provided barrier elements which can be moved into a safety position in which they block off laterally the operating area of the lifting and tipping device or tipping device. These barrier elements are intended, according to the invention, to be connected directly or indirectly to a shut-off valve lying in the pressure medium inlet line of the pressure medium-power circuit or circuits, such that the supply of pressure medium to the power circuit or circuits is open only when the barrier elements are in the safety position. This means that the automatic emptying of containers, and where possible also the hand-controlled emptying of containers, is possible only when the barrier elements are closed.

Provided, in an embodiment of the invention with joint operation of the two lifting and tipping devices or tipping devices for emptying large containers, that the electrical control is switched off for automatic operation, blocking of the power-pressure medium circuits when the barriers are open can be dispensed with, since with manual control an operator must in any case be continually present at the tipper and can then also undertake the job of safeguarding the operating area. Within the scope of the invention measures may therefore be taken by which the device may be changed selectively to the constrained safeguarding of the operating area by means of the barrier elements, or to the position in which safeguarding by means of the barrier elements is dispensed with.

As an alternative to shutting off the supply of pressure medium to the power circuit or circuits, it is also possible within the scope of the invention for the barrier elements to be connected to a main switch inserted upstream of the electrical control circuit or circuits, the main switch only being cut in when the barrier elements are in the safety position.

The barrier elements may be designed as barricade-like levers which are pivotally mounted on the lateral walls of the collecting container and are optionally joined together in the manner of a bow. These barrier elements can be operated by hand and held in their operative position and their inoperative position by means of springs. Alternatively, it is possible to actuate the barrier elements by means of pressure medium motors.

In a special, fully automatic embodiment of the device according to the invention, the electrical control circuit is connected to a programming and switching device which contains input facilities for identification data, such as type etc., about the particular container to be emptied, memories containing data about the containers that are to be emptied, circuit arrangements for determining the most suitable control method for emptying a particular container and switch facilities for setting the determined control method in the electrical control circuit. In this embodiment, the device according to the invention operates virtually fully automatically. The operator can feed in the identification data at an indicator panel, for example by means of sensors or push buttons. It is also possible, however, for a photoelectric read-in device for identification markings on the containers to be emptied to be arranged in the region of the lifting and tipping frame, or tipping frame, as input facility for the identification data. By this means, as it approaches the lifting and tipping frame, or tipping frame, the particular container to be emptied is moved past the read-in device with its identification marking.

All the necessary identification data of the container in question are thereby automatically read in. These fed-in or automatically read in identification data are compared in the programming and switching device with the stored data about the containers to be emptied. The programming and switching device contains circuit arrangements that establish from this comparison a proposal for a method of controlling the device that appears most suitable for emptying the container brought towards the device. The individual control features of this established control method are then set on the elements of the electrical control circuit by means of switch facilities. The electrical control circuit then correspondingly triggers the control valves arranged in the power-pressure medium circuit. The device according to the invention can be used in this embodiment for emptying a plurality of different container types, provided that the necessary mechanical devices are present on the tipper or tippers.

An advantageous further development of this fully automatic embodiment of the invention may consist in that the electrical control circuit and the valve control system contain linked-together additional elements for setting the lifting and tipping frame, or tipping frame, to the initial position that is suited to the containers to be emptied in each case, optionally with a connection to a facility determining the immediate weight of the collecting container. For practical operation, this additional facility means that, once the height or type of container to be emptied has been determined, first of all the lifting and tipping frame, or tipping frame, is preset to a suitable height. The immediate weight of the collecting container, the refuse lorry for example, may also be brought in for this, because, especailly on refuse lorries, the collecting container settles lower on the spring suspension with increasing weight. An especially favourable design of this additional facility can be achieved in that, using the above-mentioned photoelectric read-in device for an identification marking on the container, a suitable preset height of the tipping frame, or lifting and tipping frame, can also be read in. This may be realised in an especially favourable manner when the photoelectric reading device is arranged directly on the tipping frame, or lifting and tipping frame, and is thus moved with the frame as the height of this is set until the correct setting has been reached with respect to a height-setting marking on the container.

As a further supplementary feature of the fully automatic embodiment of the invention, the electrical control circuit and the valve control system may contain linked-together additional elements for setting the emptying speed that is suited to the containers to be emptied in each case, optionally with a connection to a facility determining the weight of the container to be emptied. Normally, when emptying large containers, only half the speed used for emptying smaller containers is set, as explained in the following embodiments. With such an additional facility, however, still further changes in and adaptations of the emptying seed can be made.

A further possible supplementation to the above-mentioned fully automatic embodiment of the invention consists in connecting a registering and recording facility for the assimilated identification data, and at least the weight of each container to be emptied, to the programming and switching device. This addition is especially advantageous wherever the weight of the refuse emptied from the containers into the collecting container is important. For example, it is in many cases customary in refuse collecting to calculate the charges according to the weight of the refuse taken away. An additional registering and recording facility which registers and records in the assimilated identification data the habitual location of the refuse bin in question and also specifies the weight of the contents of the bin, thus provides direct computation documents for the refuse collection charge.

Establishing the weight of the full container and of the emptied container may also be of considerable importance for the control of the tipper itself. For example, devices for determining the weight of the container prior to and after the emptying process may be provided on the lifting and tipping frame, or tipping frame, whilst the programming and switching device contains circuit arrangements for comparing the desired value and actual value of the weight of the container when empty; these circuit arrangements are so designed that, when the actual value exceeds the desired value by a determined degree, they cause the electrical control circuit to repeat the control of a tipping-in process, with the container being shaken during this, whilst, optionally, facilities may also be provided that trigger an alarm and/or enter a corresponding registration in a registering device when the actual value is below the desired value. The latter feature serves to safeguard the tipper and the container to be emptied, as a value below the desired value generally means that some parts or other of the container are missing and might have fallen into the tipper. Registration of the container weight below the desired value can be used in order to replace the containers in question as quickly as possible.

Finally, within the scope of the above-discussed fully automatic embodiment of the invention, it is also possible to arrange in the region of the lifting and tipping device, or tipping device, optical and/or mechanical and/or magnetic sensors for ascertaining that the condition of the container to be emptied is as it should be, and to connect them to the programming and switching device in such a manner that the emptying process is initiated only when the condition of the container attached is as it should be and/or defects detected in the condition of the container are registered in a registering device together with the identification data. This additional facility means that, at the same time as the containers are emptied, a continuous check can also be carried out on the containers, which is repeated every time they are emptied, so that defects occurring in the condition of containers can be detected in good time, their original cause investigated and eliminated.

Embodiments of the invention are explained in greater detail hereinafter with reference to the drawing, in which FIG. 1 shows in side view a lifting and tipping device according to the invention with the barrier elements open and with no containers to be emptied;

Figure 1:
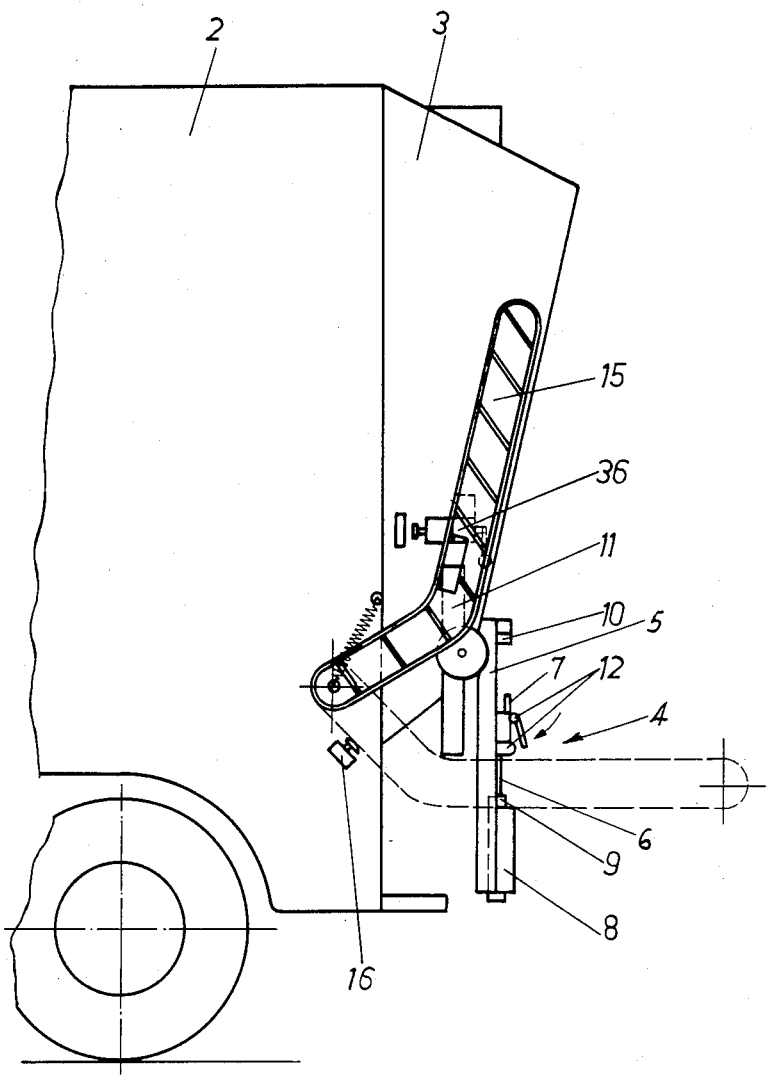
Figure 2:
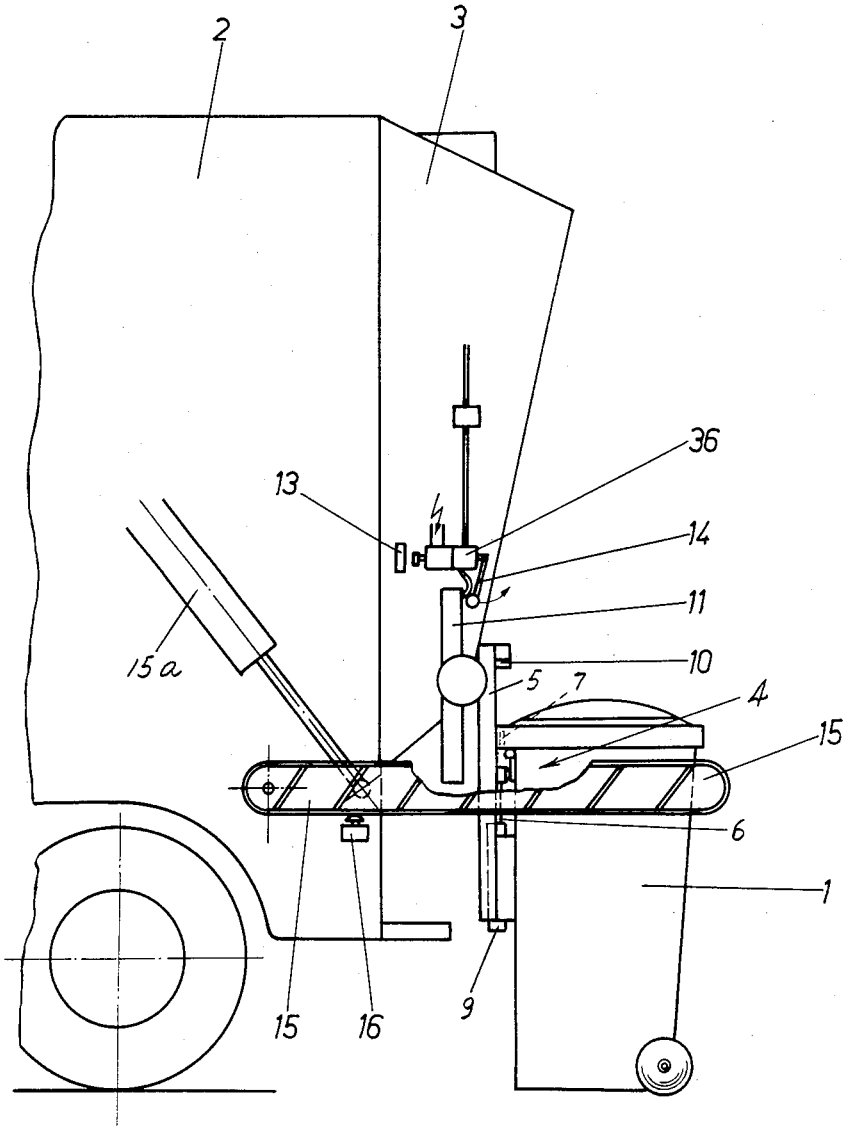
FIG. 2 shows in side view a lifting and tipping device similar to that of FIG. 1, with the barrier elements closed and a refuse bin placed on it.
Figure 3:
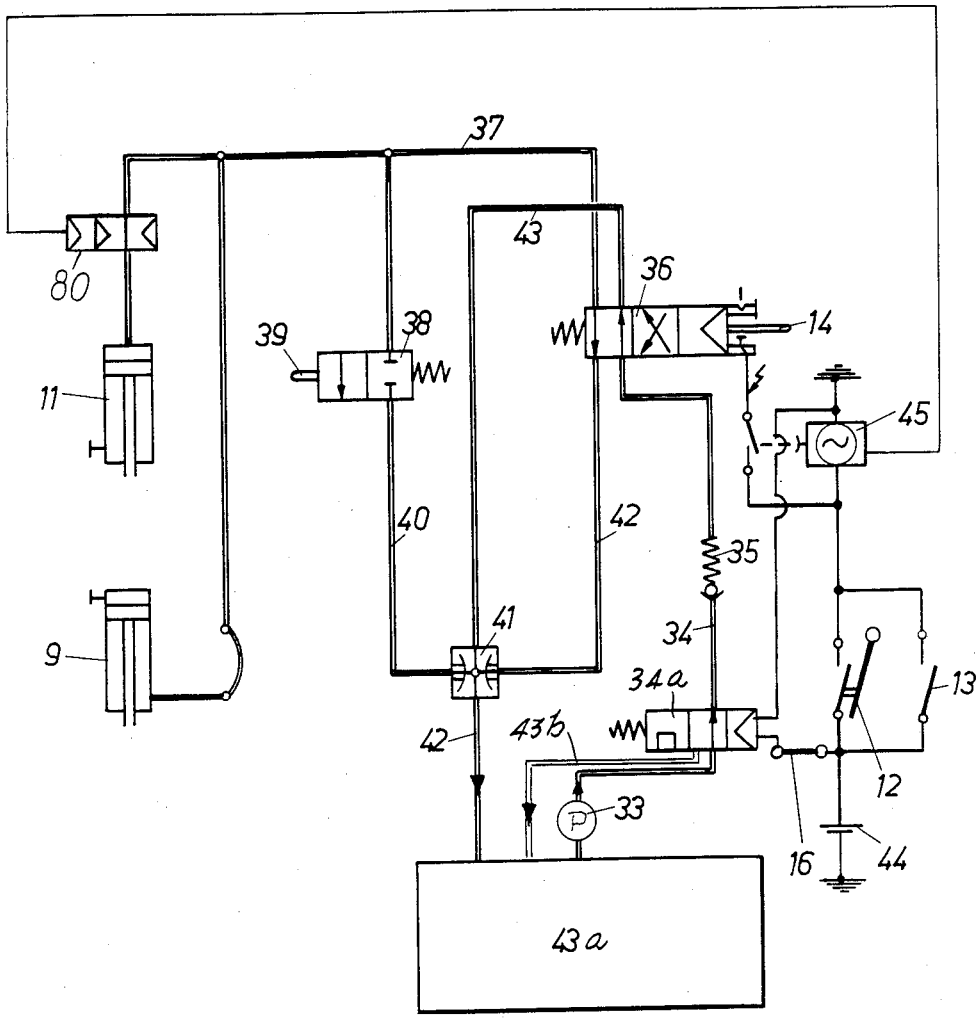
FIG. 3 shows a diagrammatic view of the hydraulic drive and control system used in a device as shown in FIG. 1 or FIG. 2 for single tippers.

The Examples illustrated in FIGS. 1 and 2 concern a lifting and tipping device for emptying refuse bins 1 into a refuse collecting container 2 of a refuse lorry having a tipping-in device 3. The tipping-in device 3 may be designed as a single tipper or as a double, or twin, tipper; in the latter case it has two tipping devices or lifting and tipping devices 4 operating independently of one another. The lifting and tipping device 4 has a swivel arm 5 or a pair of swivel arms 5, to which a lifting and tipping frame 6 is attached by means of a four-bar guide mechanism (not illustrated in detail). According to the type of container 1 to be emptied, the lifting and tipping frame 6 is equipped, in this example, on its upper part with a support ledge 7 engaging beneath the rim of the container 1, and on its lower part with an abutment element 8 which positions itself against the wall of the container 1. The diagrammatically illustrated hydraulic cylinder-piston arrangement 9 is used to raise and lower the lifting and tipping device 6. Locking of the container 1 is effected by the support ledge 7 pressing the container rim against the abutments 10 disposed on the swivel arms 5. The drive of the swivel arms 5 is effected by means of hydraulic cylinder-piston arrangements 11 which, in the Example illustrated, are designed as oscillating motors. The cylinder-piston unit 9 of the lifting device and the cylinder-piston unit 11 of the oscillating motor of each lifting and tipping device 4 are combined in a common power-pressure medium circuit (FIG. 3). This power-pressure medium circuit is so designed that at the start of operation it acts first of all on the cylinder-piston unit 9 of the lifting device and thereafter on the cylinder-piston unit 11 provided for the oscillating motor. In the Examples shown in FIGS. 1 and 2, the switch 12, which is provided for switching on the electrical control device for the automatic operation and is actuated by the container 1, is mounted beneath the support ledge 7 on the side of the lifting and tipping frame 6 facing the container wall. Alternatively, it would be possible to arrange this switch at other positions on the lifting and tipping frame 6, for example in the region of the abutment part 8. A non-contact sensor, or a light barrier, or similar means could be provided instead of the contact switch 12.

Because the containers currently in use are of quite different designs, with in some cases considerable variations in the inclination of their lateral limiting walls, it is advisable to provide, in addition to the switch 12 operated by the container, a hand-operated switch, for example a switch 12, which is located on the tipper housing at a point within easy reach of the operator. In the Example illustrated, this hand-operated switch 13 is combined with the control valve 36 arranged in the power-pressure medium circuit such that both parts have a common electromagnetic actuating device 36*a* and a common hand-operated element 14. The hand-operated switch 13 in this Example is constructed as a magnetic sensor switch, which is brought from one switch position to the other on the approach of the actuating rod guided axially through the electromagnetic actuating device 36*a* and the control valve 36.

To protect persons not involved in the operation, for example, passers-by, two barrier elements 15 are pivotally mounted on the lateral walls of the refuse lorry. These barrier elements may be combined bow-like on a common pivot axle. In the Example of FIG. 1, the barrier elements 15 may be pivoted by hand into and out of their safety position. When they pass a dead centre position, they are held in their respective upper and lower positions by a retaining spring 15*b* designed as a tension spring. In the Example of FIG. 2, a pressure medium motor 15*a* or a pair of pressure medium motors 15*a* are provided for setting the barrier elements 15. In the Examples illustrated, the barrier elements 15 actuate a switch 16 in their safety position.

The manner of operation of a device as shown in FIG. 1 or 2 constructed as a singe tipper is explained below with reference to FIG. 3:

To drive the lifting and tipping device 4, an hydraulic pressure medium system which is fed by the pressure medium pump 33 is provided. From this pressure medium pump 33 an pressure medium feed line 34 leads via a pressure medium check valve 35 to a control valve 36 constructed as a two-position valve. To this control valve 36 is attached a pressure medium inlet line 37 which leads to the pressure medium motors arranged in parallel, namely the lifting cylinder 9 and the pivoting cylinder 11. A pressure relief valve 38 with actuating element 39 is attached to the pressure medium inlet line 37. From this pressure medium relief valve 38 a pressure medium relief line 40 leads to a pressure medium return valve 41, which is inserted in the pressure medium return line 42, to improve the return of pressure medium and therewith the return movement of the cylinder piston assemblies 9 and 11. Furthermore, a bypass line 43 leads from the control valve 36 to the pressure medium return valve 41. The pressure medium return line 42 leads into a pressure medium reservoir 43*a* from which the pressure medium pump 33 draws the required amount of pressure medium for the system and introduces it into the pressure medium-power circuit by way of the pressure medium feed line 34.

A control circuit is provided for controlling this pressure medium-power circuit; it comprises the switch 12 mounted on the lifting and tipping frame 6 and actuated by the container placed thereon, and a time relay 45 connected in series with the switch 12. This time relay 45 is connected to the electrical operating device of the reversing valve 36 of the pressure medium-power circuit. The time constant of the time relay 45 is set to the duration required by the lifting and tipping device, from lifting the container, through pivoting it, until the container is completely empty.

If the switch 12 is now actuated by the container that has been placed on the frame, and so that the control circuit is connected to the source of electricity 44, then in the embodiment illustrated in the Figure an electrical contact between the source of electricity 44 and the electrical actuating device of the reversing valve 36 is produced by way of the time relay 45 for the duration corresponding to its time constant. The result of this is that, for the duration of the current conduction, the actuating device holds the control valve 36 in the working position against the restoring force of its spring. Once the control valve 36 has been brought into the working position, the pressure medium flow runs from the pressure medium pump 33 via the pressure medium feed line 34 to the pressure medium inlet line 37, and from there to the cylinder-piston assemblies 9 and 11. The piston cross-sections of these two assemblies are so matched to one another that corresponding to the initial effort to be produced by the respective assembly, the lifting cylinder 9 is designed to be more powerful than the pivoting cylinder 11. Thus, first of all the cylinder 9 is actuated until the lifting process is nearly complete, and because of the slight rise in pressure occurring thereby the tipping process is initiated by means of the pivoting cylinder 11. The significance of the pressure relief valve 38 drawn in FIG. 3 is that, in the end tipped position, a pivot limiting lever set on the pivot axle of the lifting and tipping device 4 and twisted in accordance with the swing of the pivot axle, strikes with its adjusting screw the actuating element 39 of the pressure relief valve 38. The pressure relief valve 38, which was previously in the closed position, is then brought against the action of its regulating spring into a partially open position, so that there is a reduction in pressure in the pressure medium inlet line 37 by way of the pressure relief line 40 to the pressure medium return valve 41. With a sufficiently large control interval between the actuation of the relief valve 38 and the final position of the pivot limiting lever, the pressure relief valve 38 is then opened sufficiently far for a sharp drop in pressure to occur in the pressure medium inlet line 34. This sharp decrease in pressure medium enables the lifting and tipping device, together with the container to be emptied, to pivot back sufficiently far for the pressure relief valve 38 to close again. If the pressure medium reversing valve is still in the working position, the inflowing pressure medium causes a renewed pivoting of the lifting and tipping device until the adjusting screw of the pivot limiting lever again meets the actuating element 39 of the pressure relief valve 38, and thus the decrease in pressure medium in the pressure medium inlet line 37 with the pressure relief valve open causes a corresponding return pivoting of the lifting and tipping device together with the container to be emptied. In this manner a kind of vibrating motion is produced, so that complete emptying of the container is ensured.

The complete return pivoting movement and setting down of the container is initiated in that the time relay 45, after the set duration has elapsed, interrupts the connection between the electrical actuating device of the reversing valve 36 and the source of electricity 44, whereby the reversing valve 36 is switched by means of its restoring spring into the rest position. The pressure medium coming from the pressure medium supply 33 by way of the pressure medium feed line 34 then flows away by way of the bypass line 43 through the return valve 41, exerting as it does so a suction on the return line 42 and thus reinforcing the backflow effect of the pressure medium flowing out of the cylinders 9 and 11 by way of the pressure medium inlet line 37 and the pressure medium return line 42.

As is furthermore apparent from FIG. 3, in the approach of the pressure medium-power circuit 37 to the cylinder-piston arrangement 11 there is inserted a valve 80 which rhythmically interrupts or constricts the admission of pressure medium. This valve 80 is switched in by the time relay 45 at a point in time at which the tipping process has advanced by a desired extent. The container is hereby displaced into a gentle shaking motion whereby the container is competely emptied of its contents. The valve 80 is cut out by the time relay 45 on commencement of the return pivoting process.

The switch 13 shown in FIG. 3, which is arranged parallel to the switch 12 actuated by the container 1 placed on the lifting and tipping frame 6, is the hand-operated switch for switching on the control circuit, as arranged, for example in FIG. 1 or FIG. 2.

If the emptying device is arranged on a refuse lorry, it is advantageous to use the vehicle battery as the source of electricity 44. In the case of a stationary collecting container, it would also be conceivable to provide the control circuit with a mains terminal.

Apart from the control valve 36 illustrated in FIG. 3 in its design as a two-position valve, it is also possible to use a three-position valve with an operative, return and rest position. In this case, however, more complicated components of the control circuit are required, or a more complex actuating element for such a reversing valve, for example a second time relay which, after the switch contact has been opened by the first time element, i.e. after the container has been emptied, brings the three-position reversing valve into the return position by means of the actuating device.

As FIG. 3 shows, in the pressure medium feed line 34 there is inserted a two-position shut-off valve **34*a* which is connected with its electromagnetic actuating device via the switch 16 operated by the barrier element 15 to the electrical control circuit. When the switch 16 is closed, the shut-off valve 34*a* is put into the position shown in FIG. 3, in which it clears the passage for the hydraulic pressure medium to the pressure medium feed line 34. When the switch 16 is open, the shut-off valve 34*a* positions itself under the influence of its spring in the second position, in which a bypass line 43*b* leading back to the pressure medium reservoir 43*a* is connected to the pressure side of the pump 33**.

Figure 4:
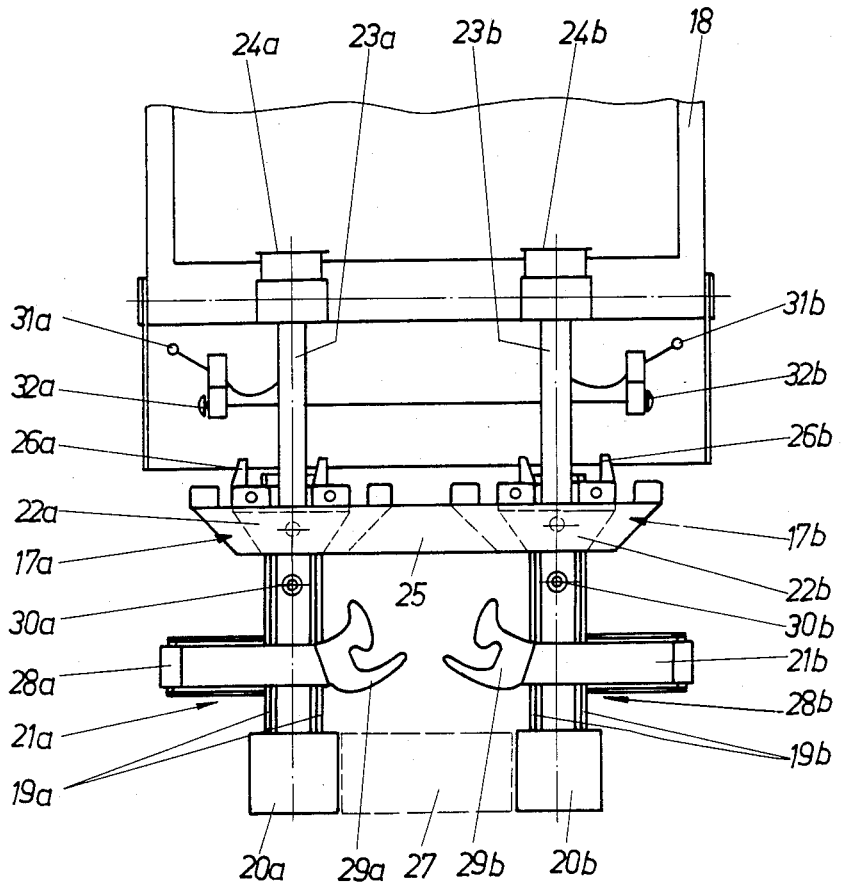
FIG. 4 is a rear view of an emptying device according to the invention as a combination tipper, that is to say, with two lifting and tipping devices which can be actuated jointly or separately arranged next to one another.
Figure 5:
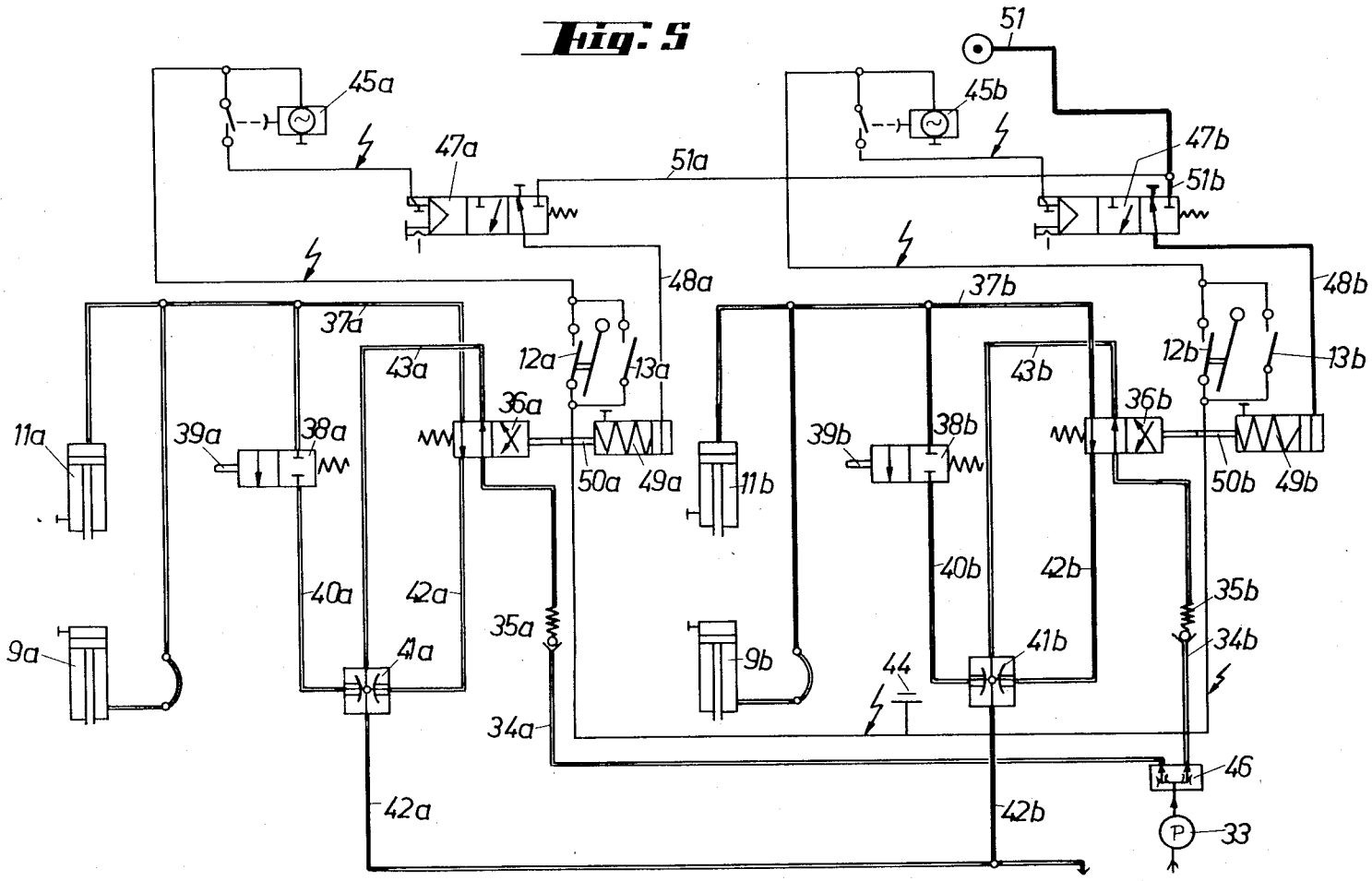
FIG. 5 is a diagrammatic view of the hydraulic drive and control system which may be used for a double or twin tipper.

When the emptying device as shown in FIG. 1 or FIG. 2 is constructed as a twin or double tipper, that is to say, is equipped with two adjacent lifting and tipping devices 4, then two identical control systems as shown in FIG. 3 may be provided, namely one for each lifting and tipping device 4. Alternatively, and preferably, a control system as shown in FIG. 5 may be used. Using a control arrangement as shown in FIG. 5, the operation of the twin or double tipper is as follows, wherein corresponding components from FIG. 3 and FIG. 5 have been given the same reference numerals, but in FIG. 4 are additionally provided with letters (a) and (b):

In the embodiment of a double tipper illustrated in FIG. 5, the two pressure medium-power circuits have a common pressure medium pump downstream of which is connected a pressure-independent pressure medium flow divider 46, so that each pressure medium-power circuit has its own pressure medium source. In the Example illustrated in FIG. 5, a common source of electricity 44 is also provided for each of the two control circuits.

Unlike the single lifting and tipping device illustrated in FIG. 3, the control circuit of each of the two single lifting and tipping devices does not act directly on the control valve **36*a*, 36*b* of the power-pressure medium circuit, but controls in its turn a pneumatic control pressure medium circuit. Each of these two control pressure medium circuits consists of a reversing valve 47*a*, 47*b* adjusted for electrical operation and connected to the corresponding control circuit, which reversing valve is attached to a supply line 48*a*, 48*b*. This pneumatic control pressure medium line 48*a*, 48*b* is attached to a working cylinder 49*a*, 49*b* loaded by a restoring spring, the piston rod 50*a*, 50*b* of which working cylinder serves as the element for actuating the control valve 36*a*, 36*b*. A common pressure medium supply 51, which is connected to the pneumatic valves 47*a*, 47*b* via the branch lines 51***a*, 51*b*, is provided for the two pneumatic control pressure medium circuits. In the case of refuse lorries, the pneumatic pressure medium source already present for the brake system of the vehicle may be used concomitantly as the pressure medium source 51.

If a container to be emptied is now placed on the lifting and tipping frame of one of these single tippers, and the time relay 45*a*, 45*b* is set in operation, then the pneumatic valve 47*a*, 47*b* is held in the contact position for the time set by the time relay 45*a*, 45*b*, so that the compressed air flowing from the pressure medium source 51 via the control pressure medium line acts on the pneumatic cylinder 49*a*, 49*b* which thereby brings the control valve 36*a*, 36*b* of the corresponding power-pressure medium circuit into the working position. The supply of pressure medium to the hydraulically operated working cylinders 9*a*, 11*a*, and 9*b*, 11*b*, is thereby released and the emptying process commences. The return pivoting and setting down operation of the lifting and tipping frame with the now emptied container is effected again as a result of the time relay 45*a*, 45*b* interrupting the circuit between the pneumatic valves 47*a*, 47*b* adjusted for electrical operation and the source of electricity 44. The pneumatic valve 47*a*, 47*b* is therefore brought into the neutral position by the restoring force of its spring so that the source of pneumatic pressure medium 51 is disconnected from the pressure medium control circuit. As a consequence of the drop in pressure occurring in the supply line 48*a*, 48*b*, the lifting piston of the pneumatic cylinder 49*a*, 49*b* loaded by the restoring force of a spring is brought into the rest position, whereupon, by means of its piston rod 50*a*, 50*b*, the control valve 36*a*, 36*b* of the power-pressure medium circuit is switched to the rest position.

The emptying device shown in FIG. 4 is a so-called combination tipper, by means of which both relatively small refuse bins and a larger container may be emptied. To that end, two adjacent lifting and tipping devices 17*a*, 17*b* are arranged on the rear of the tipping-in device 18. The drive of each of these lifting and tipping devices 17*a*, 17*b* is effected by way of their own cylinder-piston arrangements (not shown) having separate pressure medium-power circuits, so that these may be operated individually for emptying smaller containers. In individual operation, the manner in which the combination tipper functions is comparable with that of two single tippers, as explained above. The lifting device of each individual lifting and tipping device consists of the known four-bar system which is coordinated with the lifting and tipping frame 21*a*, 21*b* by means of the abutment plate 20*a*, 20*b*. Locking of the containers is effected by the support ledges 22*a*, 22*b* pressing the container rim against the locating plates 24*a*, 24*b* arranged at the upper end of the swivel arms 23*a*, 23*b*. To empty large containers, that is to say, for the synchronous operation of the two single tippers 17*a*, 17*b*, a connecting and supporting beam is affixed, for example by means of screws, to the two support ledges 22*a*, 22*b*. This connecting and supporting beam 25 is, in the Example illustrated, constructed on its upper side with teeth-like holding projections 26*a*, 26*b* arranged at intervals so that it is able to hold containers, for example refuse bins, of widely differing upper rim designs. To supplement this, an intermediate buffer 27, illustrated by a broken line, may be provided for selective use; it would be arranged between the two abutments parts 20*a*, 20*b*. To empty large conventional refuse bins with carrying lugs on their sides, in the embodiment shown in FIG. 2 of a combination tipper, pivoting support arms 28*a*, 28*b* having receiving claws 29*a*, 29*b* for the carrying lugs of these refuse bins are additionally provided on the two lifting and tipping frames 21*a*, 21*b*.

Because the time required for the emptying process may differ widely when emptying relatively large containers, so that a second emptying process might in some circumstances be necessary, where the movement sequence is controlled electrically with fixed time constants for the valve control of the power-pressure medium circuit, provision is made for the electrical control for automatic operation to be switched on only upon individual operation of the two single lifting and tipping devices 17*a*, 17*b*. For this reason, the power-pressure medium circuits of the two single lifting and tipping devices have their own control circuit. Advantageously, the switches for initiating the control sequence and actuated by the containers placed in position on the frame are located on the lifting and tipping frame 21*a*, 21*b* such that, when the connecting and supporting beam 25 is attached, i.e. when the combination tipper is equipped for synchronous operation of the two individual tippers for emptying larger containers, these switches do not come into contact with the container wall.

Because of the various designs of container, it is advisable, however, to provide an additional main switch for switching off the electrical control circuit during simultaneous operation of the two tippers 17*a*, 17*b* for emptying large containers, and this main switch may be designed and arranged in such a manner that when the connecting and supporting beams 25, or any other connecting element, is disposed between the two lifting and tipping frames 21*a* and 21*b*, it is brought into the position in which it switches off the automatic control. In this mode of operation, the two power-pressure medium circuits of the two lifting and tipping devices 17*a*,17*b* are connected to one another by means of reversing valves in such a manner that their pressure medium motors are switched in parallel, and are fed from only one source of pressure medium. To switch on the emptying device, one of the two hand-operated switches 31*a*, 31*b* arranged on the tipper housing has to be actuated. At the same time, during individual operation of the two tippers, that is to say, when the two pressure medium circuits are separated, this hand-operated switch serves for the manual control of the lifting and tipping devices 17*a*, 17*b*, should the electrical controls for the automated operation fail. Should the containers placed on the lifting and tipping frame 21*a*, 21*b* not actuate the switches 30*a*, 30*b*, two locking hand-operated switches 32*a*, 32*b* are provided on the collecting container housing 18. In this instance, although an additional operational step is required after the refuse bin has been put into position, the emptying process thereafter continues automatically, so that the operator is not tied to the location of the device during this time, as he is with the manual control of the emptying process.

Figure 6:
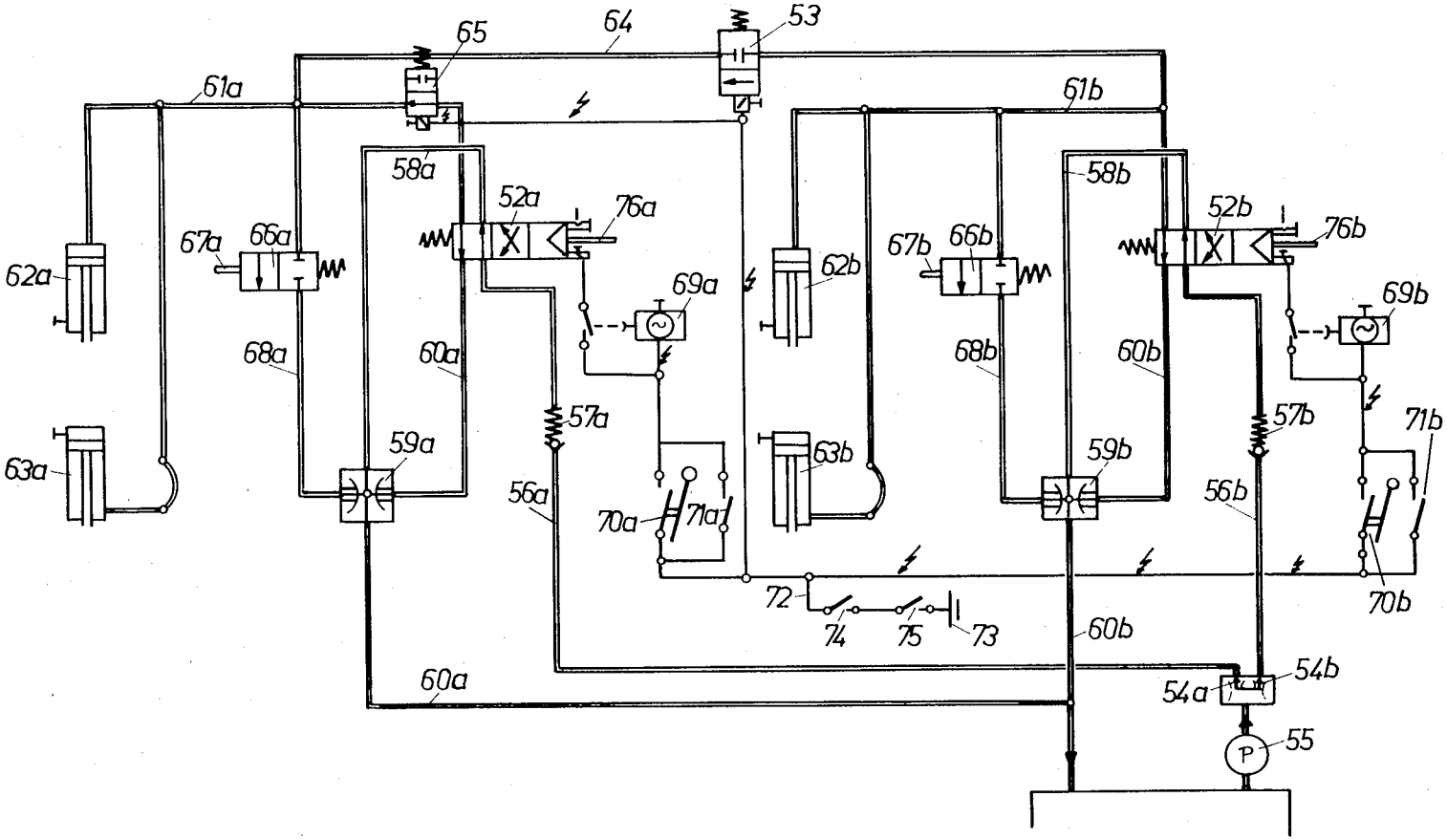
FIG. 6 shows a diagrammatic view of the hydraulic drive and control system used in the device as shown in FIG. 4.

The manner of operation of such a device is explained in detail below with reference to FIG. 6:

FIG. 6 shows a diagrammatic view of an hydraulic drive system and electrical control system for a combination tipper, as illustrated in FIG. 2. As in the case of the hydraulic diagram of a twin tipper as shown in FIG. 4, two hydraulic power-pressure medium circuits which are selectively separated or connected by way of a reversing valve 53 are also provided in this combination tipper. Each of these pressure medium circuits has its own source of pressure medium which, in the Example illustrated, may be formed by a respective branch 54*a*, 54*b* of a pressure-independent flow divider 54 in conjunction with a pressure medium pump 55 arranged upstream of this flow divider. In each power-pressure medium circuit there leads from this pressure medium source 54*a*, 54*b* a pressure medium feed line 56*a*, 56*b* by way of a check valve 57, 57*b* to the respective reversing valve 52*a*, 52*b*. This control valve 52*a*, 52*b* is joined in the neutral position to a bypass line 58*a*, 58*b* which is joined by way of a pressure medium return valve 59*a*, 59*b* to the pressure medium return line 60*a*, 60*b*. In the working position, the reversing valve 52*a*, 52*b* is joined to a pressure medium supply line 61*a*, 61*b* which conveys the hydraulic operating medium to the pressure medium motors 62*a*, 63*a* and 62*b*, 63*b* arranged in parallel.

In addition, in the embodiment illustrated in FIG. 6, in the pressure medium inlet line 61*a* between its junction with the pressure medium connecting line 64 of the two pressure medium circuits and the control valve 52*a* there is inserted a reversing valve 65 which is switched into the blocking position only in synchronous operation of the two tippers. All other components of the two power-pressure medium circuits and control circuits are arranged in an identical manner. As apparent from FIG. 6, a pressure medium relief valve 66*a*, 66*b* with actuating elements 67*a*, 67*b* is joined to each pressure medium inlet line 61*a*, 61*b*. From these pressure medium relief valves 66*a*, 66*b* pressure medium relief lines 68*a*, 68*b* lead to the pressure medium guide valves 59*a*, 59*b*. The control of the pressure medium-power circuits is effected, as in the embodiment illustrated in FIG. 3, by direct action on the reversing valve 52*a*, 52*b* adjusted for electrical actuation.

The electrical control circuits consist in each case of a time relay 69*a*, 69*b*, an operating switch 70*a*, 70*b* arranged on the lifting and tipping frame of each individual tipper, and parallel thereto a hand-operated element 71*a*, 71*b*. To ensure that the automatic control of both individual tippers is put out of operation when the operating area is unguarded, in the common connecting line 72 of both control circuits to the electricity source 73 there is installed a switch 74 actuated when the barrier elements are in the safety position. Between this switch contact 74 and the electricity source 73 there is additionally arranged a locking switch 75. As apparent from FIG. 6, the reversing valve 53 installed in the line 64 connecting the two pressure medium circuits, and the reversing valve 65 installed in the pressure medium inlet line 61*a* of just one pressure medium circuit, are arranged for an electrical actuation and, together with the control circuits, are connected to the source of electricity 73. Both reversing switches 53 and 65 are inversely switched, however, in such a manner that in individual operation of the two tippers the reversing valve 53 is in the block position and the reversing valve 65 is in the open position. In this mode of operation the switch 75 is closed, that is to say, is unlocked. However, if the bar is inserted, or the connecting and supporting beam 25 installed, that is, the switch contact 75 opened, then the reversing switch 65 installed in the pressure medium inlet line 61*a* is switched by spring force into the block position and the reversing switch 53 installed in the connecting line 64 is switched by spring force into the open position, whereupon a parallel circuit of all pressure medium assemblies 62*a*, 62*b*, 63*a*, 63*b* is produced and the emptying device is ready for synchronous operation of the two individual tippers for emptying large containers. To switch in the piston assemblies of the two tippers, then, in the embodiment illustrated in the Figure, the reversing valve 52*b* has to be actuated by means of the adjusting member 76*b* by hand. The two lifting cylinders 63*a*, 63*b* and the two pivoting cylinders 62*a*, 62*b* are charged with the same amount of pressure medium as only one liftiny cylinder 63*a* and one pivoting cylinder 62*a* in the individual control.

In the example of FIG. 6, as a consequence of the design of the reversing valve 52*a*, 52*b* as a two-position valve for the joint operation of the two tippers, the arrangement of a reversing valve in the pressure medium supply line 61*a* of one pressure medium circuit is necessary. It would also be possible to design the pressure medium reversing valves 52*a* and 52*b* as three-position valves for the neutral, lifting and lowering position, so that this additional reversing valve 65 would be redundant and the joint operation of the two lifting and tipping devices would be achieved both by actuating the left-hand and the right-hand pressure medium reversing valve 52*a*, 52*b*. However, a pressure medium reversing valve constructed for three positions would require a more complex electrical operating arrangement in order in individual operation to allow an automatic control of the two tippers.

Apart from the embodiments illustrated, a fully automatic emptying device could also be provided within the scope of the invention, with which emptying of containers of any size can be carried out automatically. Such a fully automatic emptying device is provided, for example, with a programming and switching device to which identification data such as type, size, mounting site etc. for the containers to be emptied are to be fed. Furthermore, such a fully automatic device contains in its control system a memory with data about the containers that are to be emptied. By this means, using switching arrangements, comparisons can be drawn between the identification data fed in and the stored data. From the comparison of this identification data fed in and the stored data, an emptying procedure suitable for the container in question, or the method of controlling the emptying device for this emptying procedure, can be selected and, by means of switching devices, can be set on the respective control elements of the emptying device. With such a fully automatic emptying device, the lifting and tipping frame, or tipping frame, can be brought into a suitable preliminary position for the container to be emptied even prior to the commencement of the emptying procedure. The emptying speed may be preselected. Above all, all parameters of the emptying process can be automatically preselected and set by this fully automatic device using the data of the container identified in each case, and the contents thereof. In addition, such a fully automatic device may be equipped with a device monitoring the weight of the emptied container, which device refers back to the emptying control system and has the emptying process repeated when the weight of the emptied container still lies above the desired weiht, that is to say, when a container has not been completely emptied.

Finally, with such a fully automatic emptying device, registering and recording devices may be provided which establish the identity of the emptied containers and the weight of contents emptied from each container, and also any damage to or other iregularities concerning the emptied containers.

List of reference numbers

1 Refuse bin
2 Refuse collecting container
3 Tipping-in device
4 Tipping device or lifting and tipping device
5 Swivel arms
6 Lifting and tipping frame
7 Support ledge
8 Abutment element
9 Cylinder-piston arrangement
9a Working cylinder
9b Working cylinder
10 Abutment
11 Cylinder-piston arrangement
11a Working cyliner
11b Working cylinder
12 Switch
13 Switch
14 Hand-actuated element
15 Barrier element
15a Pressure medium motor
15b Retaining spring
16 Switch
17a Lifting and tipping device
17b Lifting and tipping device
18 Tipping-in device
20a Abutment plate
20b Abutment plate
21a Lifting and tipping frame
21b Lifting and tipping frame
22a Support ledge
22b Support ledge
23a Swivel arm
23b Swivel arm
24a Locating plate
24b Locating plate
25 Connecting and supporting beam
26a Holding projections
26b Holding projections
27 Intermediate buffer
28a Support arms
28b Support arms
29a Receiving claws
29b Receiving claws
30a Switch
30b Switch
31a Hand-operated switch
31b Hand-operated switch
32a Hand-operated switch
32b Hand-operated switch
33 Pressure medium pump
34 Pressure medium feed line
34a Two-position shut-off valve
35 Pressure medium check valve
36 Control valve
36a Control valve
36b Control valve
37 Pressure medium supply line
38 Pressure relief valve
39 Actuating element
40 Pressure medium relief line
41 pressure medium return valve
42 Pressure medium return line
43 Bypass line
43a Pressure medium reservoir
43b Bypass line
44 Source of electricity
45 Time relay
45a Time relay
45b Time relay
46 Pressure medium flow divider
47a Reversing valve
47b Reversing valve
48a Supply line
48b Supply line.
49a Working cylinder
49b Working cylinder
51 Pressure medium source
50a piston rod
50b Piston rod
51a Branch line
51b Branch line
52a Reversing valve
52b Reversing valve
53 Reversing valve
54 Flow divider
54a Pressure medium source
54b Pressure medium source
55 Pressure medium pump
56a Pressure medium feed line
56b Pressure medium feed line
57a Check valve
57b Check valve

I claim:

1. A device for emptying refuse bins (1) into a collecting container (2), said device comprising in combination:

(a) a tipping frame (6) for holding a refuse bin (1), said tipping frame being movable between a first, bin-receiving position and a second, bin-emptying position, (b) a source (33) of pressurized fluid, (c) a fluid-actuated motor (9) for shifting said tipping frame between said first and second positions, (d) valve means (36) connected with said source (33) of pressurized fluid and said fluid-actuated motor (9), for controlling the shifting movement of the tipping frame (6) between said first and second positions, by the fluid-actuated motor (9), (e) said valve means (36) comprising an actuating mechanism, (f) a timer (45), for controlling the actuating mechanism of the valve means (36), (g) switch means (12) responsive to placement of a refuse bin (1) on the tipping frame (6), for automatically initiating operation of the timer (45), (h) said timer (45) being characterized by a predetermined timing interval, said interval being at least sufficiently long to enable the fluid-actuated motor (9) to shift the tipping frame (6) from its first position to its second position after operation of the timer (45) is initiated by the switch means (12), (i) said timer (45), upon expiration of said timing interval, effecting movement of the actuating mechanism of the valve means (36) to a position causing said tipping frame (6) to return to its first, bin-receiving position.

2. The invention as set forth in claim 1, wherein:

(a) said switch means (12) is operated by mechanical engagement with a part of the refused bin (1).

3. The invention as set forth in claim 1, and further including:

(a) a manually-operable switch (13), separate from said first-mentioned switch means (12), (b) said manually-operable switch (13) being connected to the said timer (45) in parallel to said first-mentioned switch means (12).

4. The invention as set forth in claim 3, wherein:

(a) said manually-operable switch (13) is disposed on the actuating mechanism of the valve means (36), and has an exposed lever by which it can be operated.

5. The invention as set forth in claim 1, and further including:

(a) a pair of barrier elements (15) pivotally mounted on the lateral walls of the collecting container (2), which can be moved into a safety position in which they block off laterally the area around the tipping frame (6).

6. The invention as set forth in claim 11, and further including:

(a) a shut-off valve (34*a*) interposed between the source of pressurized fluid and the valve means (36), and (b) an electrical switch connected with said shut-off valve, said shut-off valve being closed and preventing movement of the tipping frame (6) when the barrier elements are not in their safety positions.

7. The invention as set forth in claim 6, wherein:

(a) said shut-off valve (34*a*) has biasing means maintaining it normally in a shut-off condition.

8. The invention as set forth in claim 5, and further including:

(a) a fluid-actuated motor (15*a*) connected with the barrier elements (15), for moving them toward and away from their safety position.

9. The invention as set forth in claim 1, wherein:

(a) said timer (45) effects movement of the actuating mechanism of the valve means (36) to a position causing said tipping frame to return to its first, bin-receiving position in the event that the switch means (12) is opened during the said predetermined timing interval.

10. The invention as set forth in claim 1, and further including:

(a) a reversing valve (47*a*, 47*b*) hydraulically connected to the pressurized fluid source (51), and electrically interposed between the timer (45*a*, 45*b*) and the valve means (36*a*, 36*b*), (b) said reversing valve (47*a*, 47*b*) having a manually engageable member enabling it to be manually operated, so as to permit by-passing of the said timer (45*a*, 45*b*).

11. The invention as set forth in claim 1, wherein:

(a) said pressurized fluid source comprises a pressure fluid reservoir, (b) a pressure fluid pump (33) and a pressure fluid feed line (34) extending from said pressure fluid pump (33) to said valve means (36), (c) a pressure fluid supply line (37) extending from said fluid-actuated motor (9) to said valve means (36), (d) a first pressure fluid return line extending from said valve means (36) to said pressure fluid reservoir, (e) a second pressure fluid return line extending from said pressure fluid supply line (37) to said pressure fluid reservoir and including a pressure relief valve (38) arranged to be normally in closed position and to be moved into its open position when the said tipping frame (6) comes into its bin-emptying position, and (f) a by-pass line (43) extending from said valve means (36) to said presure fluid reservoir, (g) said valve means (36), during movement of said tipping frame toward its bin-emptying position, connecting said pressure fluid feed line (34) with said pressure fluid supply line (37) and said by-pass line (43) with said first pressure fluid return line (42), or connecting said pressure fluid feed line (34) with said by-pass line (43) and said pressure fluid supply line (37) with said first pressure fluid return line (42) for venting the fluid into said pressure fluid reservoir from said pressure fluid pump and from said pressure fluid-actuated motor (9) during movement of the tipping frame toward its bin-receiving position.

12. The invention as set forth in claim 1, and further including:

(a) a valve (80) disposed between the fluid actuated motor (9, 11) and source of pressurized fluid (33), for rhythmically interrupting the fluid pressure applied to the fluid-actuated motor so as to vibrate the refuse bin (1) while it is tilted and thereby assist in the emptying thereof into the container (2).

13. A device for emptying refuse bins into a collecting container, said device having two tipping frame (17*a*, 17*b*) adapted to hold two refuse bins, respectively and having two fluid-actuated motors (62*a*, 62*b*, 63*a*, 63*b*) respectively operating said frames and controlled by two valves in a hydraulic pressure source, said valves each being connected with an actuating mechanism, each of the latter being operated by a control circuit having a timing device regulating the opening and closing of the respective valve, characterized in that each of the control circuits contains a switch for initiating the control sequence, said switches being actuated when the refuse bin is placed on either tipping frame of the emptying device, and an additional valve (53) for selectively connecting the fluid-actuated motors in parallel and to the hydraulic pressure source (55) when it is desired that the frame operate in synchronism together.

14. The invention as set forth in claim 13, characterized in that there are two hyraulic lines connected to the pressure source and having a common junction, and a second reversing valve (65) which is controlled inversely to the first reversing valve (53) is provided and is inserted in one of the two hydraulic lines of the hydraulic system upstream of the junction of the hydraulic lines (64) with respect to the pressure source for the motors (62*a*, 63*a*).

* * * * *